US005802942A

United States Patent [19]

Cornell et al.

[11] Patent Number: 5,802,942

[45] Date of Patent: Sep. 8, 1998

[54] PAPER TRIMMER

[75] Inventors: Robert W. Cornell, Schofield, Wis.; Suk Ku An, Gyunggido, Rep. of Korea

[73] Assignee: Fiskars Inc., Madison, Wis.

[21] Appl. No.: 544,397

[22] Filed: Oct. 10, 1995

[51] Int. Cl.[6] ..... B26D 1/04; B26D 7/02

[52] U.S. Cl. ..... 83/455; 83/175; 83/564; 83/614; 402/4

[58] Field of Search ..... 83/455, 578, 614, 83/175, 564; 402/4

[56] References Cited

U.S. PATENT DOCUMENTS

| | | | |
|---|---|---|---|
| 101,542 | 4/1870 | Teed . | |
| 180,362 | 7/1876 | Montgomery . | |
| 318,556 | 5/1885 | French . | |
| 1,075,050 | 10/1913 | Mihills . | |
| 1,327,154 | 1/1920 | Golden . | |
| 1,572,304 | 2/1926 | Morton | 83/455 |
| 1,576,800 | 3/1926 | Tibony . | |
| 1,825,266 | 9/1931 | Fischer . | |
| 1,895,754 | 1/1933 | Finkenwirth . | |
| 2,233,497 | 3/1941 | Teigen . | |
| 2,255,196 | 9/1941 | Taylor . | |
| 2,291,294 | 7/1942 | Holste . | |
| 2,298,024 | 10/1942 | Vallerelli . | |
| 2,327,223 | 8/1943 | Silver . | |
| 2,456,436 | 12/1948 | Metzger . | |
| 2,537,473 | 1/1951 | MuCusker . | |
| 2,688,187 | 9/1954 | Pauli . | |
| 2,753,938 | 7/1956 | Thiess . | |
| 2,803,303 | 8/1957 | Matthew . | |
| 3,015,889 | 1/1962 | Godman . | |
| 3,139,124 | 6/1964 | Hoff . | |
| 3,142,217 | 7/1964 | Busse | 83/455 |
| 3,142,426 | 7/1964 | Busse . | |
| 3,153,853 | 10/1964 | Lipton . | |
| 3,227,016 | 1/1966 | Moeller . | |
| 3,237,497 | 3/1966 | Cook . | |
| 3,301,117 | 1/1967 | Spaulding . | |
| 3,370,497 | 2/1968 | Busse . | |
| 3,385,149 | 5/1968 | Johnson . | |
| 3,430,339 | 3/1969 | Hobson . | |
| 3,532,018 | 10/1970 | Szabo | 83/455 |
| 3,543,627 | 12/1970 | Hearns . | |
| 3,779,119 | 12/1973 | Broides . | |
| 3,821,915 | 7/1974 | Larrable . | |
| 3,824,688 | 7/1974 | Goffe . | |
| 3,835,536 | 9/1974 | Marcoux . | |
| 3,898,735 | 8/1975 | Himeno . | |
| 3,973,459 | 8/1976 | Stowe . | |
| 4,096,631 | 6/1978 | Ward . | |
| 4,156,382 | 5/1979 | Baker | 83/455 X |
| 4,197,774 | 4/1980 | Singh et al. | 83/455 X |
| 4,267,638 | 5/1981 | Heinz . | |
| 4,516,452 | 5/1985 | Dahle . | |
| 4,530,154 | 7/1985 | DiCarlo . | |
| 4,662,258 | 5/1987 | Mood . | |
| 4,686,876 | 8/1987 | Hume . | |
| 4,798,112 | 1/1989 | Kozyrski et al. | 83/455 |
| 4,967,628 | 11/1990 | Judd et al. | 83/455 |
| 4,987,812 | 1/1991 | Benavidez . | |
| 5,069,097 | 12/1991 | Mori . | |
| 5,322,001 | 6/1994 | Boda . | |
| 5,398,576 | 3/1995 | Chiu | 83/455 X |
| 5,409,317 | 4/1995 | Bedol | 402/4 X |
| 5,524,515 | 6/1996 | Boda | 83/455 |

FOREIGN PATENT DOCUMENTS

| | | |
|---|---|---|
| 9307856.0 | 8/1993 | Germany . |

*Primary Examiner*—Eugenia Jones
*Attorney, Agent, or Firm*—Foley & Lardner

[57] ABSTRACT

A paper trimmer includes a base and a plate pivotally attached to the base. A carrier is slidably attached to the plate in an elongated slot. A blade assembly includes a blade secured to a blade holder. The blade assembly is received in a cavity formed in the carrier such that a cutting edge of the blade extends below the plate and is received within a channel formed in a cutting region of the base when the plate is disposed over the cutting region. A paper is cut by translation of the carrier along the slot of the plate.

15 Claims, 3 Drawing Sheets

PAPER TRIMMER

FIELD OF THE INVENTION

This invention relates to paper trimmers and more particularly to a personal paper trimmer in which a carrier holding a blade is slidably traversed in a slot of a plate across paper or the like to be cut.

BACKGROUND OF THE INVENTION

Conventional paper cutters typically include an elongated blade pivotally attached to a cutting board at one end. In these "guillotine-type" cutters the elongated blade is lowered about the pivot thereby cutting a paper or material by shearing action. The elongated blade is often exposed which may pose a significant danger especially for use by children. Another drawback of this type of cutter is the overall size which makes it difficult to easily and conveniently transport them for personal use.

A more recent style of paper cutter includes a blade attached to a carrier which is translated along a rail assembly. The rail assembly may be pivoted at one end to permit loading and unloading of the material to be cut as disclosed in U.S. Pat. No. 5,069,097 entitled "PAPER-CUTTING MACHINE AND METHOD OF CUTTING PAPER" to Mori issued on Dec. 3, 1991. The rail assembly may also be pivoted at both end of the rail assembly as disclosed in U.S. Pat. No. 5,322,001 assigned to assignee of the present application and entitled "PAPER CUTTER WITH CIRCULAR BLADES" to Boda issued on Jun. 21, 1994. Or alternatively the rail may be stationary as disclosed in U.S. Pat. No. 3,301,117 entitled "PAPER CUTTER" to D. E Spaulding issued on Jan. 31, 1967.

Attempts have also been made to combine a cutter with a ruler. For example U.S. Pat. No. 1,895,754 entitled "MEASURING STICK" to Finkenwirth issued on Jan. 31, 1933 discloses a cloth cutting device having two members hingedly connected and biased together with a spring. A blade secured to a slide is moved along a longitudinal slit in the members.

Additionally, U.S. Pat. No. 4,987,812 entitled "COMBINATION RULER AND CUTTER GUIDE" to Benavidez issued on Jan. 29, 1991 discloses a cutter member which is slidably guided within a slot in a ruler. The cutter member includes a rearward portion from which a blade is attached that is proximate the outside edge of the ruler.

The cutters in all of the U.S. Patents noted above employ a spring to activate the blade. In the '754 patent to Finkenwirth the measuring stick members are biased together by a spring. In the remainder of the U.S. Patents noted above the blades are forced into engagement by pressing on the carrier and depressing a spring. The blade is disengaged by releasing the carrier and allowing the spring to force the blade away from the cutting board. These assemblies require a number of components to house the springs.

Accordingly, it would be desirable to have a paper cutter that would be safer for children to use, portable, and made from fewer components.

SUMMARY OF THE PRESENT INVENTION

A paper trimmer in accordance with one aspect of the present invention comprises a base including a support surface and a cutting region having a channel. A plate is pivotally attached to the base and includes an upper surface, a lower surface, a first end, and a second end. A slot extends through the plate along a longitudinal axis of the plate intermediate the first and second ends. The paper trimmer further comprises a carrier having a blade attached thereto. The carrier and blade are slidably received in the slot. A portion of the blade extends below the lower surface of the plate into the channel.

Another aspect of this invention includes a blade holder having a first portion and a second portion hingedly connected to the first portion. The blade holder includes locating means for positively locating the blade within the first and second portions. The blade holder and blade are slidably received within a cavity located in the carrier.

In another aspect of this invention the base includes first and second sides, each side having an aperture. The plate includes a first arm extending from the first end and a second arm extending from the second end. Each arm includes a post which is pivotally received within the aperture.

A further aspect of the invention includes means for snap fitting the carrier within the slot. Additionally, the lower surface of the plate may include a recessed track formed proximate the slot to receive a lower flange of the carrier. The lower surface may also include a pair of ribs extending from the lower surface of the plate proximate the recessed track.

Other principal features and advantages of the invention will become apparent to those skilled in the art upon review of the following drawings, the detailed description and the appended claims.

BRIEF DESCRIPTION OF THE DRAWINGS

The invention will hereafter be described with reference to the accompanying drawings, wherein like reference numerals denote like elements, and.

DETAILED DESCRIPTION

Figure 1:
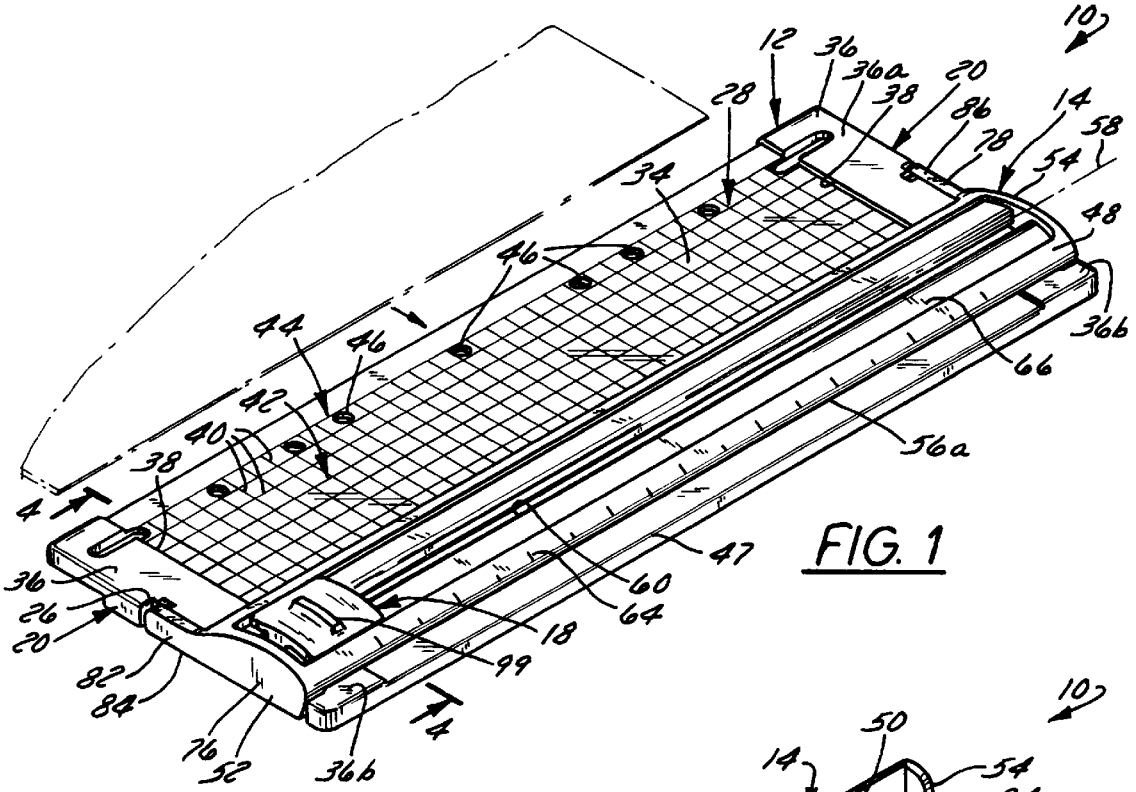
FIG. 1 is an isometric view of the paper trimmer with the plate in the lowered position.
Figure 2:
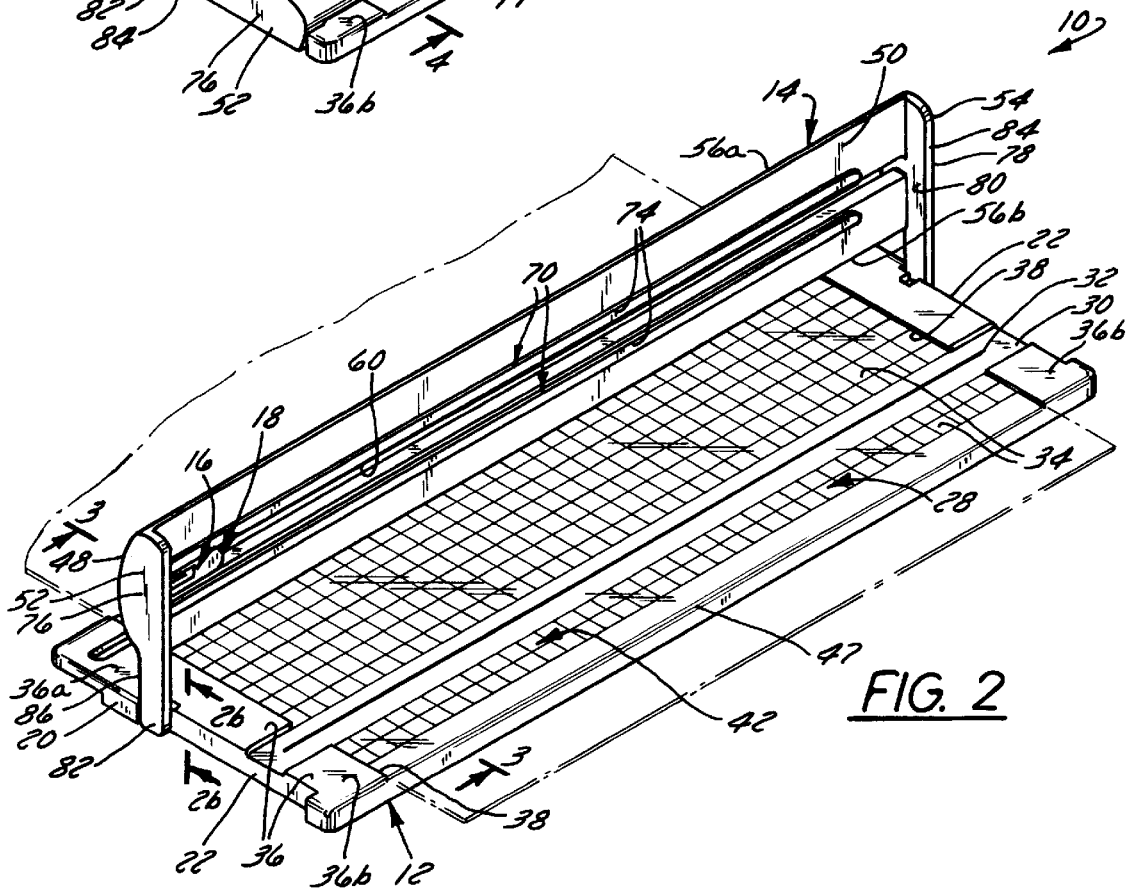
FIG. 2 is an isometric view of the paper trimmer with the plate in the raised position.
Figure 3:
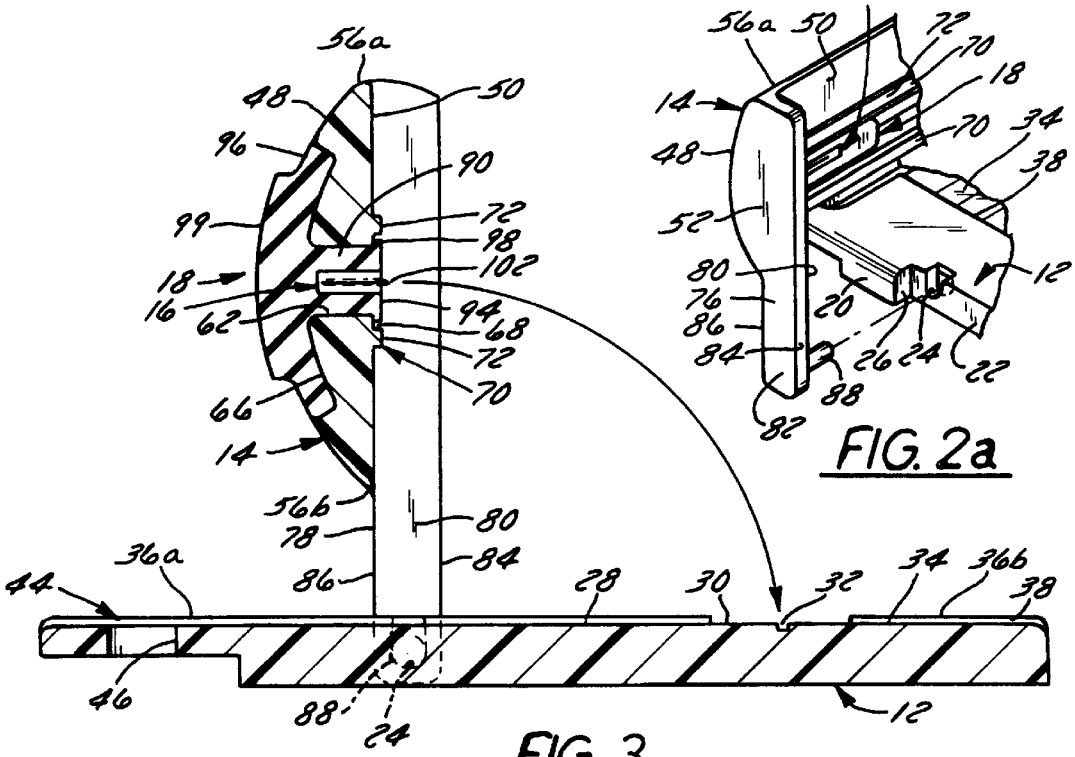
FIG. 3 is a cross-sectional view taken generally along line 3—3 of FIG. 2.
Figure 2A:
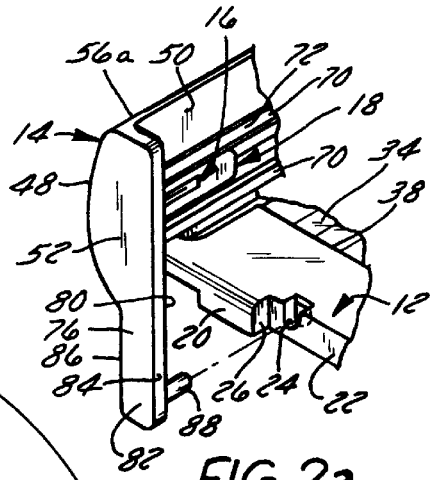
FIG. 2*a* is a fragmentary exploded view of the plate and base.
Figure 5:
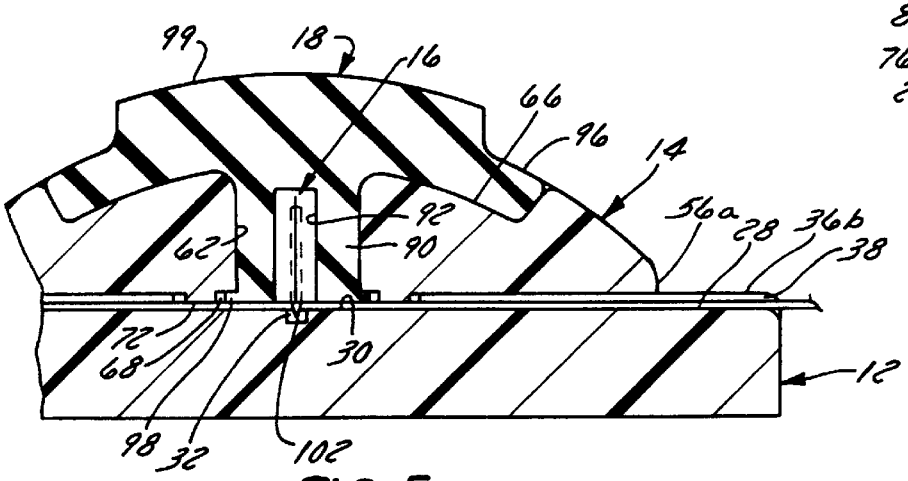
FIG. 5 is an enlarged fragmentary cross-sectional view of FIG. 4.
Figure 2B:
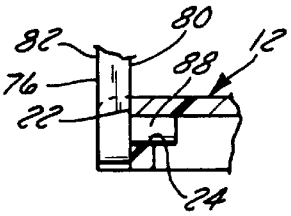
FIG. 2*b* is a fragmentary cross-sectional view taken generally along line 2*b*—2*b* of FIG. 2.
Figure 4:
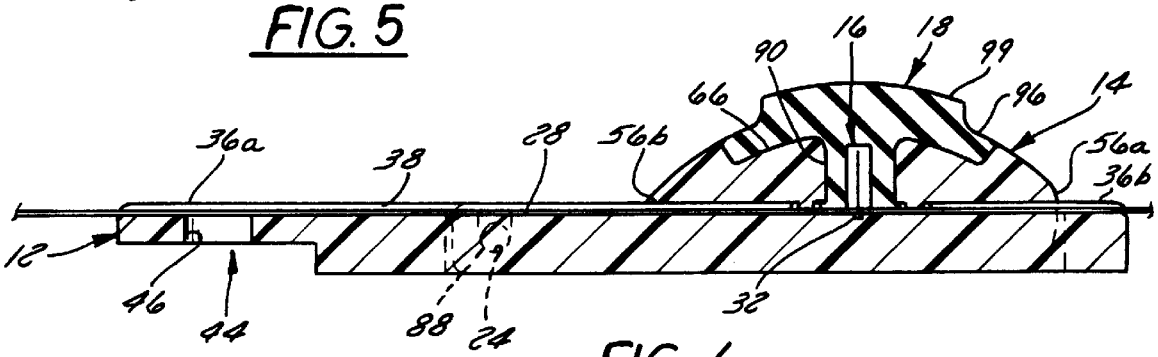
FIG. 4 is a cross-sectional view taken generally along line 4—4 of FIG. 1.
Figure 6:
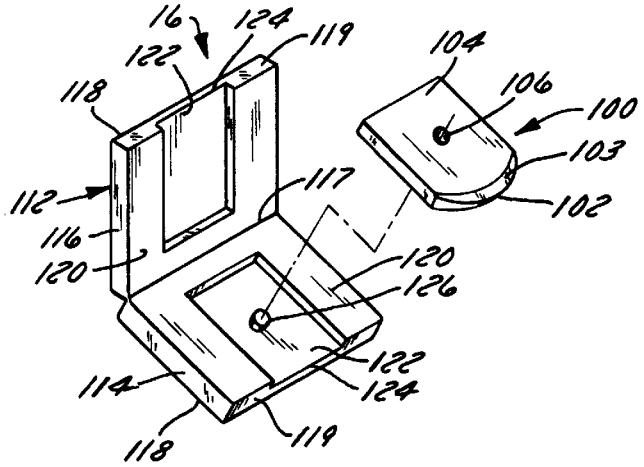
FIG. 6 is an exploded view of the blade assembly shown in the raised position.

Referring to FIGS. 1, 2 and 6 a detailed description of an exemplary paper trimmer 10 will be described. Trimmer 10 includes a base 12, and an elongated plate 14 pivotally attached to base 12. A blade assembly 16 is attached to a carrier 18 which is slidably attached to elongated plate 14.

Referring to FIGS. 1–5 base 12 will be described in greater detail. Base 12 includes a pair of sides 20, each side 20 includes a recess 22 having an aperture 24. Each recess 22 has a wall 26 proximate aperture 24.

Base 12 also includes a top surface 28 having a cutting region 30 provided with a channel 32 extending substantially the entire distance between sides 20. Top surface 28 also includes a support surface 34. A pair of raised guides 36 are integrally formed with top surface 28 and are located proximate sides 20. Each raised guide 36 includes a guide wall 38 normal to top surface 28. Further, each raised guide 36 includes a first guide portion 36*a* on one side of channel 32 and a second guide portion 36*b* on the other side of channel 32.

Top surface 28 also preferably includes a plurality of grooves 40 forming a grid 42. As shown in FIGS. 1 and 2 there are no grooves 40 proximate channel 32 in cutting region 30. However, in an alternative embodiment, grid 42 may be formed by printing lines instead of employing grooves 40. Further it may be possible to eliminate grid 42 and grooves 40 altogether.

Base 12 also includes an attachment edge 44 normal to sides 20. Attachment edge 44 includes a plurality of apertures 46 to permit attachment to a standard ring binder (not shown). Additionally, an alignment edge 47 is located parallel to and distal from attachment edge 46.

Referring to FIGS. 1–4, elongated plate 14 includes an upper surface 48, an oppositely facing lower surface 50, a first end 52, a second end 54, and first and second edges 56*a*, 56*b* parallel to a longitudinal axis 58 of plate 14. Plate 14 further includes a slot 60 extending through plate 14 along longitudinal axis 58. Slot 60 includes a pair of slot walls 62 and extends intermediate first end 52 and second end 54. In the preferred embodiment upper surface 48 has an arcuate shape terminating at edges 56*a*, 56*b*. However, upper surface 48 may have other shapes as well such as a planar shape. Further a scale 64 is printed on upper surface 48 proximate each edge 56*a*, 56*b*. Alternatively scale 64 may be etched into or otherwise formed integrally with upper surface 48. Plate 14 further includes a top recess 66 proximate both sides of slot 60.

Lower surface 50 further includes a bottom recess 68 proximate slot 60 forming a track parallel to slot walls 62 (See FIGS. 3–5 and 11). Lower surface 50 includes a pair of ribs 70 extending parallel to longitudinal axis 58, each rib 70 being located proximate a side of bottom recess 68. Each rib 70 includes a rib surface 72 raised from lower surface 50 and a pair of rib ends 74.

Plate 14 also includes a first arm 76 attached to first end 52, and a second arm 78 attached to second end 54. In the preferred embodiment, first and second arms 76, 78 are integrally formed with first and second ends 52, 54 respectively. Each arm 76, 78 extends downward from lower surface 50 and beyond first edge 56*a* in a direction normal to longitudinal axis 58. Each arm 76, 78 includes an inner side 80, an outer side 82, a bottom edge 84 and a top edge 86. Each arm 76, 78 further includes a post 88 extending from inner side 80. Plate 14 is formed from a resilient material such as plastic so that arms 76, 78 can be conveniently forced apart such that they spring back to their original position when released. In this manner arms 76, 78 may be attached to apertures 24 as will be explained in further detail below.

Referring to FIGS. 3–5 and 11, carrier 18 includes a foot 90 having a width less than that of slot 60. Carrier 18 also includes a blind cavity 92 formed in foot 90 and extending from foot bottom 94. Carrier 18 includes a top flange 96 having a width greater than that of slot 60 but less than that of top recess 66. Carrier 18 also includes a bottom flange or lip 98 having a width greater than that of slot 60 but less than that of bottom recess 68. In the preferred embodiment carrier 18 is also provided with a handle 99.

Figure 7:
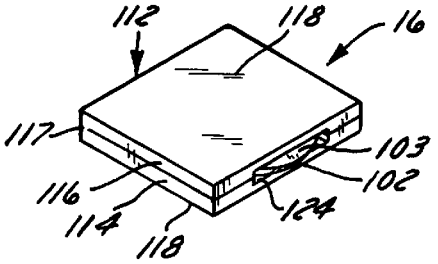
FIG. 7 is an isometric view of the blade assembly shown in the lowered position.
Figure 8:
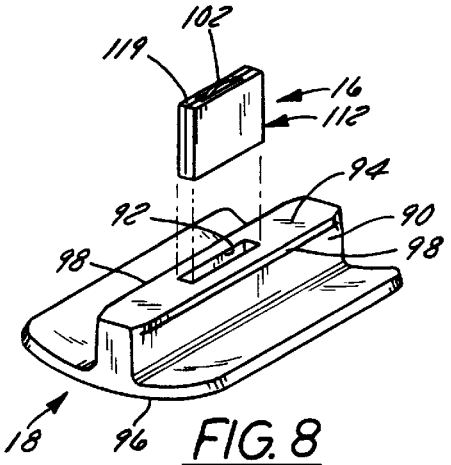
FIG. 8 is an exploded view of the carrier and blade assembly.
Figure 10:
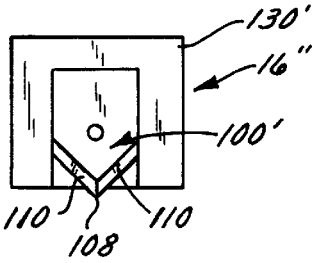
FIG. 10 is another a top view of a blade assembly of another alternative embodiment.
Figure 11:
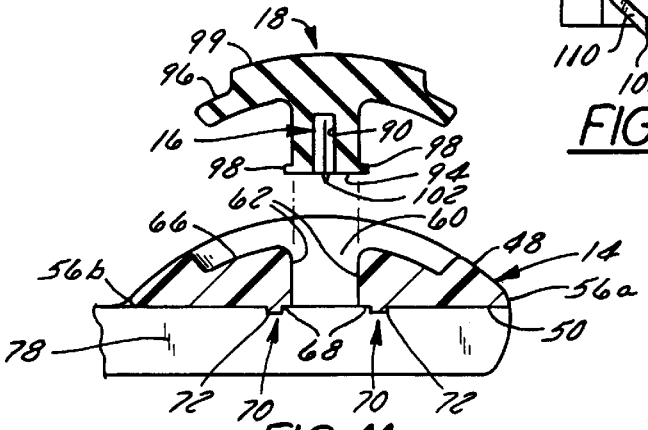
FIG. 11 is an exploded cross sectional view of the carrier and plate in the lowered position taken generally along line 4—4 of FIG. 1.

Referring to FIGS. 6 and 7, blade assembly 16 includes a blade 100 having a cutting edge 102, and a main portion 104 provided with an aperture 106. In the preferred embodiment, cutting edge 102 has an arcuate shape. However other configurations may be used, for example, cutting edge 102 may be V-shaped with an apex 108 and a first and second cutting portion 110 diverging from apex 108 (See FIG. 10). In this alternative embodiment, the angle formed by cutting portions 110 is approximately 45 degrees.

Blade assembly 16 also includes a blade holder 112, having a first portion 114, a second portion 116, and an integrally formed hinge 117 connecting first and second potions 114, 116. Each portion 114, 116 includes an outer surface 118, an inner surface 120 and an holder edge 119 opposite hinge 117. Each portion 114, 116 includes a depression 122 configured to receive blade 100. Depression 122 includes an opening 124 at holder edge 119. A stud 126 projecting from depression 122 is integrally formed with first portion 114. Alternatively, stud 126 may be integrally formed with second portion 116.

Figure 9:
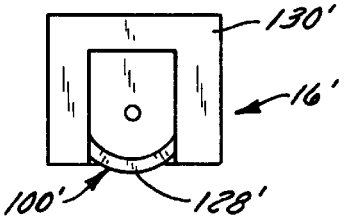
FIG. 9 is top view of a blade assembly of an alternative embodiment.

In an alternative embodiment a recess may be formed within depression 122 of second portion 116 to positively receive stud 126. In another alternative embodiment (See FIGS. 9 and 10) a blade 100' is spot welded to a metal member 130' such that a portion of a cutting edge 128' extends beyond a bottom edge of metal member 130'.

The assembly and operation of paper trimmer 10 will now be described. Plate 14 is pivotally attached to base 12 by forcing arms 76, 78 apart such that posts 88 are received within apertures 24. Plate 14 is pivotally attached to base 12. As illustrated in FIGS. 1 and 2 base 12 has a length along the longitudinal axis 58 substantially equal to the length of plate 14. Additionally, base 12 has a width (normal to longitudinal axis 58) greater than that of plate 14 such that support surface 34 extends beyond edges 56*a*, 56*b*. This aids in the stability and operation of the trimmer.

In the lowered or closed position (See FIG. 1) upper surface 48 of plate 14 is facing away from base 12. Likewise, rib surface 72 of ribs 70 are in contact with top surface 28 of base 12. Additionally, in the lowered position outer side 82 of arms 76, 78 are substantially flush with sides 20 of base 12. Further, plate 14 is free to pivot from a lowered position in which top edge 86 of arms 76, 78 are substantially flush with top surface 28 of base 12 (See FIG. 1), to a raised or open position in which top edge 86 of arms 76, 78 are substantially normal to top surface 28 (See FIG. 2). In the fully raised position top side 86 of arms 76, 78 are supported by walls 26 allowing plate 14 to remain substantially normal to top surface 28. The extension of ribs 70 from lower surface 50 aid to shield blade 100 from a user when plate 14 is in the raised position.

Blade 100 is attached to blade holder 112 by positioning blade aperture 106 over stud 126 such that blade cutting edge 102 extends beyond opening 124. Main portion 104 of blade 100 is positively located within depression 122. Second portion 116 is folded about hinge 117 such that the inner surfaces 120 are in contact. (See FIGS. 6 and 7).

Blade assembly 16 is slidably attached within cavity 92 of carrier 18. In the preferred embodiment, blade holder 112 is press fit within cavity 92 such that holder edge 119 is substantially flush with foot bottom 94 and a portion 103 of cutting edge 102 extends beyond opening 124. Preferably, holder edge 119 protrudes no more than 0.005 inches from foot bottom 94. In the preferred embodiment cutting edge 102 extends approximately 0.015 inches below foot bottom 94 of carrier 18. However, cutting edge 102 may extend a greater or lesser distance below foot 94 as well. Additionally, in the preferred embodiment the included angle of cutting edge 102 is between 30 and 40 degrees. Carrier 18 is snap fit within slot 60 of plate 14. Plate 14 is formed of a resilient material permitting bottom flange 98 of carrier 18 to be placed through slot 60. Carrier 18 is slidably received within slot 60 such that top flange 96 is resting on top recess 66 and bottom flange 98 is received within bottom recess 68. In this orientation, blade 100 is centered in slot 60.

Paper trimmer 10 may be stored in a ring binder by attaching the rings to apertures 46. Paper trimmer 10 may be used either while attached to the ring binder or removed from the ring binder. To cut paper or like material, a user first pivots plate 14 to the raised position as described above. The paper or like material to be cut is then placed on the support surface 28 of base 12 such that the region where a cut is to be made overlies channel 32. Plate 14 with carrier 18 situated in a position proximate one of the ends 52, 54 of plate 14 is then pivoted into the lowered position. In the lowered position rib surface 72 of ribs 70 are resting on the paper to be cut. To cut the material, the user slides carrier 18 along longitudinal axis 58 such that portion of cutting edge 103 travels within channel 32 as it traverses across the material. The symmetric nature of cutting edge 102 permits translation and cutting of the material in either direction along longitudinal axis 58. The absence of grooves 40 in cutting region 30 aids in the smooth translation of carrier 18 over cutting region 30 during cutting of the material.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

For example plate 14 may be hingedly connected to base 12. Alternatively, plate 14 may be connected at one end only such that longitudinal axis 58 is normal to base 12 when plate 14 is in the raised position. Also, posts 88 may be formed on base 12 and apertures 24 may be formed on arms 76, 78. Similarly, snap means may include carrier 18 having a flexible bottom flange 98 and a rigid plate 14. Also, carrier 18 may have a groove intermediate the upper and lower surfaces 48, 50 which receives a flange extending from foot 92. Further, blade 100 may be located within holder 112 by a combination of notches in blade 100 and matching protrusions in holder 112. These other configurations and constructions are considered to be within the scope of the present invention. Thus, these and other substitutions and modifications may be made in the design and arrangement of elements disclosed herein without departing from the scope of the appended claims.

What is claimed is:

1. A paper trimmer comprising:

a base including a pair of sides, a support surface, and a cutting region having a channel;

a plate pivotally attached to the base and including an upper surface, a lower surface, a first end, a second end, and a slot extending through the plate along a longitudinal axis of the plate intermediate the first and second ends;

a carrier being slidably received in the slot, the carrier including a top flange, wherein the plate is formed of resilient material; and a blade attached to the carrier, wherein a portion of the blade extends below the lower surface of the plate within the channel when the plate is disposed over the cutting region; wherein the upper surface of the plate and the top flange of the carrier have complementary arcuate shapes and the top flange engages the upper surface.

2. The paper trimmer of claim 1, wherein the carrier includes the top flange having a width greater than that of the slot and a bottom flange having a width greater than that of the slot.

3. The paper trimmer of claim 2, wherein the carrier further includes a handle portion to facilitate slidable movement of the carrier by the user.

4. The paper trimmer of claim 2 wherein the lower surface further includes a recessed track formed proximate the slot for receiving the bottom flange of the carrier.

5. The paper trimmer of claim 4, wherein the lower surface further includes a pair of ribs proximate the recessed track.

6. The paper trimmer of claim 1, wherein the base includes an attachment edge having a plurality of aperture configured for attachment to a ring binder.

7. The paper trimmer of claim 1, wherein the support surface includes a raised guide proximate one of the sides to align the paper or material to be cut.

8. The paper trimmer of claim 1, further comprising: a blade assembly including a blade holder having a first portion and a second portion hingedly connected to the first portion, the blade holder including locating means for positively locating the blade within the first and second portions, the carrier including a cavity to slidably receive the blade assembly.

9. The paper trimmer of claim 8, wherein the locating means includes a stud attached to one of the portions, the blade includes a cutting edge and a foot having an aperture sized to receive the stud.

10. The paper trimmer of claim 9, wherein the blade cutting edge is arcuate.

11. The paper trimmer of claim 9, wherein the blade cutting edge has an apex formed at the juncture of a first cutting portion and a second cutting portion diverging away from one another thereby permitting the user to cut paper by movement of the carrier in either direction along the longitudinal axis.

12. The paper trimmer of claim 1, wherein each side of the base has an aperture, the plate further including a first arm extending from the first end and a second arm extending from the second end, the first and second arms each including a post pivotally received in a respective aperture.

13. The paper trimmer of claim 1, wherein the carrier is formed of resilient material.

14. A paper trimmer comprising:

a base including a support surface, and a cutting region having a channel;

a plate movably attached to the base and including oppositely facing upper and lower surfaces, an elongated slot therethrough, a top recess in the upper surface proximate the longitudinal sides of the slot, a first end, and a distal second end;

a carrier including a top flange having a pair of oppositely extending sides, and a foot extending from the top flange, the foot being slidably received within the slot, and a portion of the pair of oppositely extending sides being slidably received within the top recess; and a blade at ached to the carrier, wherein a portion of the blade extends below the lower surface of the plate within the channel when the plate is disposed over the cutting region;

wherein the upper surface of the plate and the top flange of the carrier have complementary arcuate shapes, wherein the plate is formed of a resilient material.

15. The paper trimmer of claim 14, further including a pair of ribs projecting from the lower surface by a predetermine distance proximate the elongated slot.

* * * * *